United States Patent [19]

Griffith

[11] 4,085,643

[45] Apr. 25, 1978

[54] TRUNCATED DECAY SYSTEM

[75] Inventor: Glen Griffith, Westminister, Calif.

[73] Assignee: Nippon Gakki Seizo Kabushiki Kaisha, Hamamatsu, Japan

[21] Appl. No.: 773,980

[22] Filed: Mar. 3, 1977

[51] Int. Cl.[2] ..... G10H 1/00

[52] U.S. Cl. ..... 84/1.01; 84/1.24

[58] Field of Search ..... 84/1.01, 1.03, 1.11, 84/1.12, 1.13, 1.24, 1.26, 1.19

[56] References Cited

U.S. PATENT DOCUMENTS

| | | | |
|---|---|---|---|
| 3,519,723 | 7/1970 | Wiest | 84/1.13 |
| 3,610,806 | 10/1971 | Deutsch | 84/1.13 |
| 3,844,379 | 10/1974 | Tomisawa | 84/1.03 |

*Primary Examiner*—Robert K. Schaefer
*Assistant Examiner*—William L. Feeney
*Attorney, Agent, or Firm*—Spensley, Horn & Lubitz

[57] ABSTRACT

In this monophonic pedal or truncated decay system, depression of a new pedal key immediately truncates tone production of a previously played, decaying note. If two notes are played simultaneously, both will sound until one is released, whereupon that tone will be truncated immediately without decay.

The inventive system operates with a time-shared electronic musical instrument wherein selected keys are assigned to respective time slots in a repetitive timing interval. During each such interval, a first flip-flop is set by occurrence of the first assigned pedal key. A second flip-flop cooperates with the first flip-flop, and is set during each time interval by occurrence of a second assigned pedal key. A third flip-flop is set at the end of each timing interval to copy the contents of the second flip-flop. The third flip-flop thus provides, during the subsequent timing interval, a signal indicating that two or more pedal keys are being played. Concurrence of this signal and another signal indicating that a pedal key has been released results in production of an inhibit signal that is used to prevent the sounding of such released, decaying pedal note.

4 Claims, 4 Drawing Figures

TRUNCATED DECAY SYSTEM

BACKGROUND OF THE INVENTION

1. Field of the Invention

The present invention relates to a system for truncated decay or monophonic pedal in an electronic musical instrument.

2. Description of the Prior Art

Although it is generally desirable to allow two or more notes to be played simultaneously on one keyboard of an electronic musical instrument, there are situations when more than one note at a time is unwanted. An example of such a situation is in the imitation of a wind instrument which is capable of sounding only one note at a time. Another example arises when playing the pedal notes of an electric organ. There, the simultaneous generation of two or more low notes might produce an unmusical sound.

In the past, various approaches have been used to limit the number of tones that can be produced simultaneously. Typically these systems were associated with the pedal keys of an electronic organ or with a pedal clavier. Often they involve the immediate truncation of a sustained or decaying tone as soon as the next pedal key is depressed. For example, in the U.S. Pat. No. 2,480,132 to Hammond, there is disclosed a pedal clavier in which each pedal-operated switch is maintained in operated condition and released only upon the depression of another pedal. In this type of instrument, the tone of the last depressed pedal persists with gradual decay until a second pedal is depressed.

In the U.S. Pat. No. 3,227,799 to Holman, the playing of one note on the pedal board cuts off sustained playing of any other note. To accomplish this, Holman uses a tone gating system in which the tone generator for each note is connected to a common output via a respective diode. When a particular note is selected, the corresponding diode is forward biased by a negative voltage from an associated capacitor that is rapidly charged via a neon bulb associated with the selected note. Cancellation of all other notes is accomplished by simultaneously applying a high positive voltage to all of the remaining neon bulbs. This causes these neons to fire and to apply a positive potential to the corresponding capacitors, thereby biasing the corresponding diodes off. No other tone then is gated to the common output.

In the electronic musical instrument disclosed in U.S. Pat. No. 3,446,904 to Brand, a selected tone gate is maintained open after key release by the charge on an associated capacitor. The decay time is determined by the value of this capacitor and a resistor that is common to all of the gate decay circuits. Truncation of a decaying note is accomplished by a killer circuit that momentarily short circuits all of the capacitors, thereby discharging them and terminating their maintaining action on the corresponding tone gates.

A similar technique for accomplishing sustain and cancellation of sustain upon playing of a subsequent pedal is disclosed in the U.S. Pat. No. 3,480,719 to Schwartz. There, too, a slowly discharged capacitor is used to control the sustain. If the capacitor is still charged, so that the previous note is still decaying when a subsequent note is played, a transistor switch circuit is turned on to discharge the capacitor in very short order, thereby cancelling the note that was decaying. A similar technique is employed in the sustain tone device disclosed in U.S. Pat. No. 3,519,723 to Wiest. There, a knock-off circuit is provided for discharging the capacitors associated with the time-delay tone sustain circuit, so that a note can be abruptly terminated when a subsequent key is depressed.

Another type of monophonic pedal system is disclosed in the U.S. Pat. No. 3,585,892 to Nakajima et al. In this type of system, if two or more keys are simultaneously depressed, only the selected tone having the lowest or highest frequency is generated. This is accomplished by using a set of tone gates connected across a power supply in ascending order according to the note frequencies. If two or more keys are depressed, only the normally non-conducting switching device closest to the power supply becomes conductive so as to open the corresponding highest or lowest frequency key gate.

In the U.S. Pat. No. 3,882,751 to Tomisawa et al, a time-shared system is shown in which a monophonic pedal effect is achieved by restricting the assignment of pedal keys to only one channel. Thus if a second pedal key is depressed, there is no channel available, and it will not be sounded. A decay truncation circuit permits the subsequent pedal note to be assigned to the one channel if the prior key has been released and is in the process of decay.

It is an object of the present invention to provide a monophonic pedal or truncated decay system for an electronic musical instrument. Another object is to provide such a system for a time-shared musical instrument, advantageously but not necessarily of the digital tone generation type.

A further object of the present invention is to provide a decay truncation system that is effective only after one of the notes has been released. That is, if two or more keys are depressed simultaneously, both will sound. However, as soon as one is released, its tone will not decay, but will be truncated immediately. Similarly, if only a single decaying tone is being generated, this tone will be truncated immediately upon depression of the next key.

SUMMARY OF THE INVENTION

These and other objectives are achieved by providing a truncated decay system for use with a time-shared electronic musical instrument wherein the key codes for selected notes are assigned to respective time slots in a repetitive timing interval. In the truncation circuit, a first flip-flop is set during each timing interval upon occurrence of the first pedal note. If a second pedal note occurs during the same timing interval, a second flip-flop also is set. Its output signal in turn sets a third flip-flip which provides a signal indicating that at least two notes are being played.

If any of these played pedal notes is in the decay process, a release signal is provided during the same time slot as the corresponding key code. Concurrence of the release signal and the third flip-flop output, indicating that more than one note is being played, produces an inhibit signal which prevents generation of the released tone.

BRIEF DESCRIPTION OF THE DRAWINGS

A detailed description of the invention will be made with reference to the accompanying drawings wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention is best defined by the appended claims.

Figure 1:
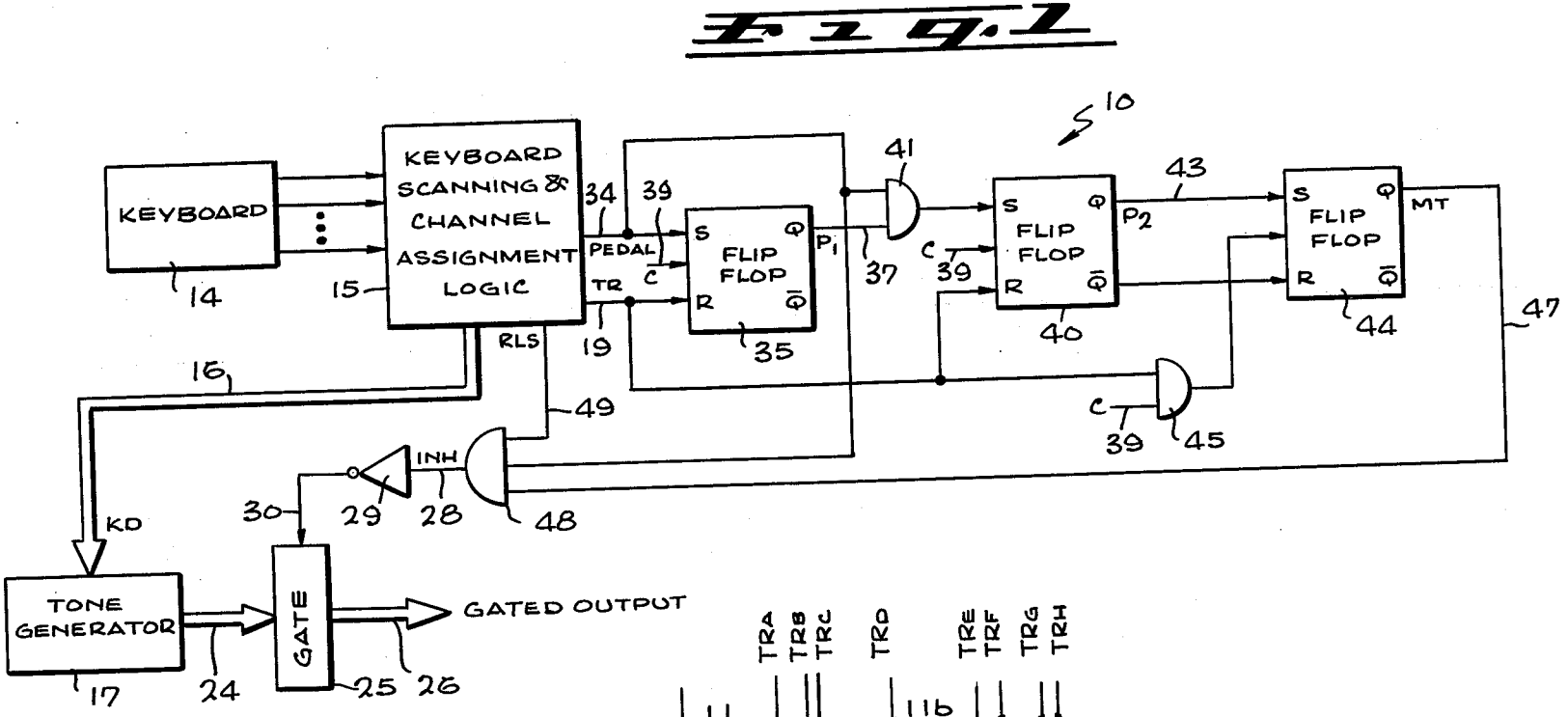
FIG. 1 is an electrical schematic diagram of the inventive truncated decay system.
Figure 2:
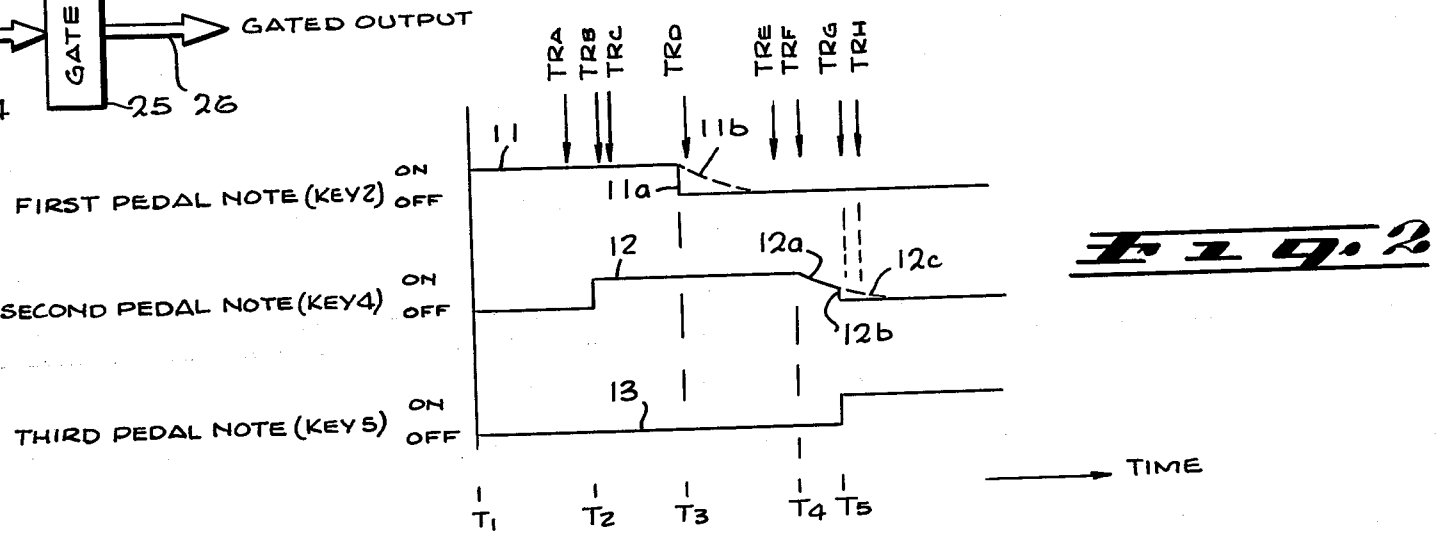
FIG. 2 is a diagram illustrating the truncated decay operation of the system of FIG. 1.

The inventive system 10 of FIG. 1 is used to truncate the decay of pedal notes under certain conditions illustrated in FIG. 2. As seen therein, at time $T_1$ only a first pedal note (indicated by the waveshape 11) is being sounded. A second pedal note (waveshape 12) is played at time $T_2$. With the system 10, both the first and second pedal notes are sounded simultaneously (during the time interval from $T_2$ to $T_3$) until one of the notes is released at time $T_3$. The released note is truncated immediately, as indicated at 11*a*, and does not go through the normal decay illustrated by the broken curve 11*b*.

Figure 3:
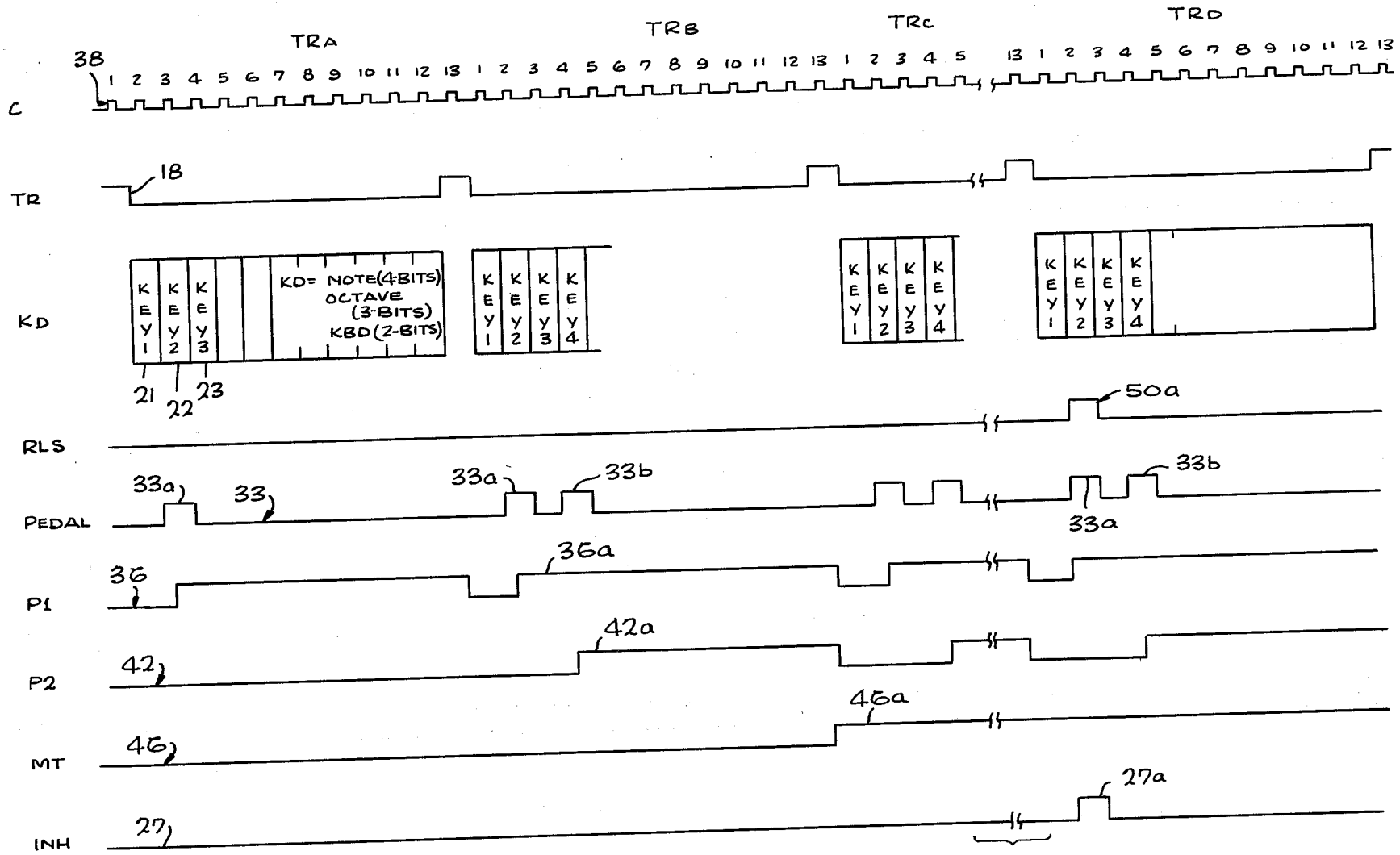
FIGS. 3 and 4 are waveshapes illustrating operation of the system of FIG. 1.

In the event that only a single pedal note is being sounded, and this note is decaying, the decay is truncated immediately on selection of a new note. This situation also is illustrated in FIG. 3, at time $T_5$. When the second pedal note is released at time $T_4$, the tone begins to decay as indicated at 12*a*. When the third pedal note (waveshape 13) is selected at time $T_5$ the decaying second pedal note is truncated immediately, as shown at 12*b*, and the completion of the decay 12*c* is not sounded.

To facilitate this truncated decay operation, the circuit (FIG. 1) is employed with a musical instrument having a keyboard 14 which typically includes both manual and pedal keys. Keyboard scanning and channel assignment logic 15, known per se, provides time shared key data KD via a line 16 to a tone generator 17. The tone generator is time-shared to produce a plurality of tones corresponding to selected keyboard keys, which are identified by the key data KD. The keyboard scanning and channel assignment logic may be similar to that disclosed in U.S. Pat. No. 3,882,751 to Tomisawa, without the restriction that a pedal note can be assigned to only one channel.

In a typical embodiment, the logic 15 provides consecutive key data KD codes during twelve time slots of a repetitive timing interval defined by a timing reference TR pulse (waveshape 18 of FIG. 3) provided on a line 19. Each such key data KD code includes a note-designating byte (typically 4 bits), an octave-designating byte (typically 3 bits), and a keyboard-designating byte (typically 2 bits). This information is sufficient to inform the tone generator 17 which note is to be sounded.

For example, if three keys are selected on the keyboard 14 (herein designated "key 1", "key 2" and "key 3"), the corresponding three key data KD codes will be provided on the line 16 during the first three time slots 21, 22, 23 (FIG. 3) of each time interval. The tone generator 17 will provide these notes in time shared fashion via a line 24 and a normally enabled gate 25 to an output line 26.

The gate 25 is used by the circuit 10 to inhibit the tone output for a truncated note. Normally an inhibit signal INH (waveform 27) on a line 28 is low, causing the output of an inverter 29 to provide a high enable signal via a line 30 to the gate 25. This is the situation e.g., during the time interval from $T_1$ to $T_3$ of FIG. 2. After the time $T_3$, the inhibit INH signal goes high, as indicated at 27*a* of FIG. 3, so as to terminate the enable signal on the line 30 and disable the gate 25. The inhibit INH pulse 27*a* occurs only during the time slot to which the truncated note is assigned. In the example of FIGS. 2 and 3, this is the second time slot, to which the first pedal note ("key 2") is assigned. During the other time slots, the inhibit INH signal is low so that the gate 25 is enabled to provide output of the other notes.

To produce the inhibit INH signal, the circuit 10 is responsive to a PEDAL signal (waveshape 33 of FIG. 3) provided from the logic 15 on a line 34. This signal is obtained by reference to the keyboard-designating bits of the key data KD code. When the truncation is applied to the pedal keyboard, a high PEDAL signal occurs during each time slot for which the corresponding key data KD code is associated with a pedal key. Thus, during a typical timing interval $TR_A$ (FIG. 3), which represents the situation between the times $T_1$ and $T_2$ (FIG. 2), three keys are selected, of which only "key 2" is from the pedal keyboard. Thus, a high PEDAL signal 33*a* occurs only during the second time slot.

Occurrence of the first high PEDAL pulse during each timing interval sets a first flip-flop 35 to the Q state. The resultant $P_1$ output (waveshape 36) on a line 37 indicates that at least one pedal key is depressed. The flip-flop 35 is reset, terminating the high $P_1$ signal, upon occurrence of the timing reference TR signal at the end of each timing interval. Setting and resetting of the flip-flop 35 is synchronized with the trailing edge of a system clock pulse C (waveshape 38) provided on a line 39.

The selection of two pedal notes is recognized by a second flip-flop 40, the operation of which is illustrated during the timing interval $TR_B$ that occurs just after a second pedal note ("key 4") is selected at $T_2$. During this timing interval $TR_B$ the PEDAL signal is high during both the second (33*a*) and fourth (33*b*) time slots. The signal $P_1$ goes high (36*a*) during the second time slot, and is still high during the fourth time slot. This enables both inputs of an AND-gate 41 and sets the flip-flop 40 to the Q state. As a result, a $P_2$ signal (waveshape 42) on a line 43 goes high (43*a*) indicating that two pedal keys have been selected.

Near the end of the timing interval $TR_B$, but before the flip-flop 40 is reset by the timing reference TR pulse, a third flip-flop 44 is set to copy the state of the flip-flop 40. The flip-flop 44 is clocked by the output from an AND-gate 45 that receives the TR and C pulses as inputs. If the flip-flop 40 has been set, the flip-flop 44 also is set to the Q state, thereby providing a high MT signal 46*a* on a line 47. The MT signal 46 thus designates whether or not two or more pedal keys have been selected.

The flip-flop 44 remains set during the following time interval $TR_C$, as indicated in FIG. 3. During this interval an inhibit INH signal is not produced, since at no time does a three input AND-gate 48 receive high signals at all of its inputs.

An inhibit operation does occur when the first pedal note ("key 2") is released at the time $T_3$. During the next timing interval $TR_D$, the flip-flop 44 still is set to provide a high MT signal 46*a* to one input of the AND-gate 48. During the second time slot, the PEDAL signal 33*a* is high, providing a second input to the AND-gate 48. Upon release of "key 2", the logic 15 provides on a line 49 a high RLS pulse which is the third high input to the AND-gate 48. As a result, this gate produces the inhibit INH pulse 27*a* which causes the gate 25 to be disabled. As a result, the first pedal note ("key 2") is not sounded. That is, this note is truncated immediately upon release of the pedal key. A similar inhibit operation occurs during each successive timing interval for the duration of the decay curve 11*b*.

Figure 4:
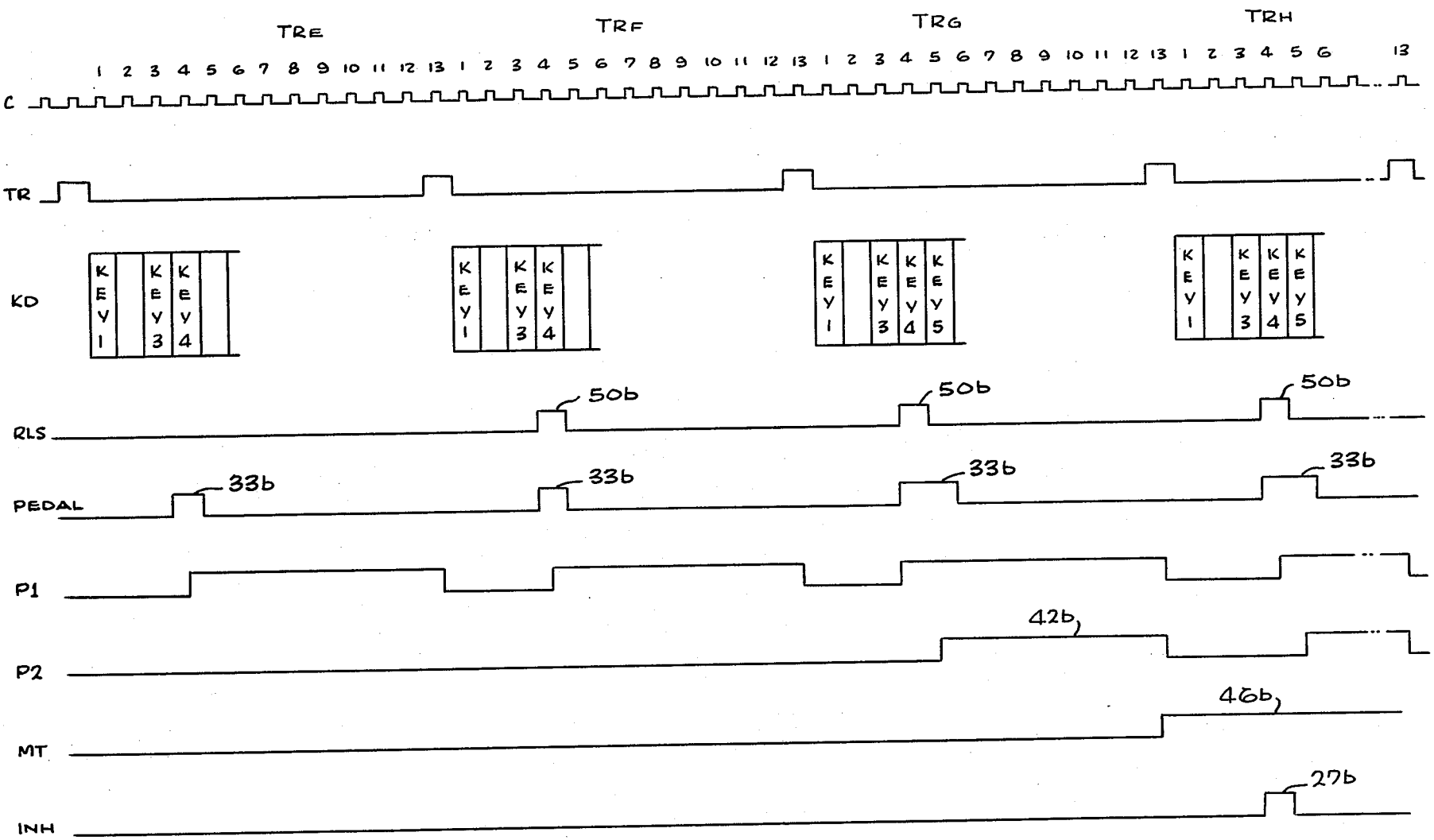

At the end of that time, but before the release at $T_4$ of the second pedal note ("key 4"), the operation of the circuit 10 is typified by the waveshapes of timing interval $TR_E$ in FIG. 4. This is similar to the interval $TR_A$, except that only "key 4" is sounding. The flip-flop 44 is not set, so that the MT signal remains low. The situation after release of "key 4" is typified by the timing interval $TR_F$. An RLS signal 50*b* occurs during the fourth time slot, but no inhibit INH signal is produced since the MT signal remains low. Under these conditions, the tone generator 17 produces the "key 4" pedal note with a normal decay, as indicated by the waveshape 12*a* of FIG. 2.

When another pedal note ("key 5") now is depressed at time $T_5$, the flip-flop 40 is set during the fifth time slot of the next timing interval $TR_G$, as indicated by the waveshape 42*b* in FIG. 4. Thus, at the end of this timing interval $TR_G$ the flip-flop 44 is set to produce a high MT signal 46*b*. During the next timing interval $TR_H$, a high inhibit INH pulse 27*b* is produced during the fourth time slot. As a result, production of the "key 4" pedal note is truncated, as indicated at 12*b* in FIG. 2. During successive like timing intervals, the inhibit pulse 27*b* also is produced, thereby inhibiting production of the second pedal note throughout the remainder of the decay curve 12*c*.

Although in FIG. 1 the gate 25 is shown connected in the output path from the tone generator 17, the invention is not so limited. The gate 25 may be used in any circuit of the associated musical instrument wherein tone production will be inhibited. For example, certain electronic musical instruments utilize an envelope generator to provide a signal which establishes the current amplitude of the produced tone. The gate 25 may be interposed in the output of such envelope generator. When inhibited, the gate 25 would provide a zero level envelope, so that the amplitude of the tone would be zero, and the note would not be sounded. Alternatively, the gate 25 may be used to inhibit output data from a frequency or spectrum generator for the musical instrument.

In the illustrative embodiment of FIG. 1, the truncated decay system 10 is responsive only to notes from the pedal keyboard. However, the invention is not so limited. The same truncated decay system could be applied to the notes from any designated keyboard. In that instance, a corresponding keyboard designating signal would be provided on the line 34 instead of the PEDAL signal. For example, the keyboard-designating byte of the key data KD code may be two bits long. The binary code 01 may designate the upper manual, the code 10 may designate the lower manual, and the code 11 may designate the pedal keyboard. If the truncated decay system (FIG. 1) is to be used for the lower manual, then a simple decode circuit responsive to the keyboard designating code 10 may be used to provide on the line 34 the signal indicating that the key assigned to the corresponding time slot is in the lower manual. The circuit 10 will operate to truncate decay of tones played on this lower manual in the manner exactly like that described above.

Intending to claim all novel, useful and unobvious features, shown or described, the inventor claims:

1. A truncated decay system for a time-shared electronic musical instrument of the type wherein selected keys are assigned to respective time slots in a repetitive timing interval, said instrument providing, at each such time slot, a keyboard signal designating the keyboard of the key assigned to that time slot, and a release signal indicating whether the corresponding key has been released so that the note is decaying, said truncated decay system being associated with a designated keyboard, comprising:

first bistable circuit means, reset at the beginning of each timing interval, connected to said musical instrument so as to be set during each timing interval by occurrence of the first keyboard signal corresponding to the designated keyboard, second bistable circuit means, reset at the beginning of each timing interval, and connected to said first bistable circuit means so as to be set during each timing interval by occurrence of a second keyboard signal for the designated keyboard, and inhibit means, responsive to setting of said second bistable circuit means and to said release signal and operative during the following timing interval, for inhibiting production of the note corresponding to each released assigned key of said designated keyboard when at least one key of said designated keyboard is still actuated, irrespective of whether all of the time slots currently have keys assigned to them.

2. A truncated decay system according to claim 1 wherein said inhibit means comprises:

a third bistable circuit means, operatively connected to copy the setting of said second bistable circuit means at the end of each timing interval, said third bistable circuit means thereby indicating throughout the following timing interval whether at least two keys of said designated keyboard are being played, and gate means for providing a note inhibit signal in response to concurrence during the same time slot of (a) a keyboard signal corresponding to the designated keyboard, (b) an output from said third bistable circuit means indicating that at least two keys of said designated keyboard are being played, and (c) said release signal.

3. A truncated decay system according to claim 2 wherein said first, second and third bistable circuit means respectively comprise first, second and third flip-flops, wherein said first flip-flop is set by the first keyboard signal corresponding to said designated keyboard, and wherein said second flip-flop is set by concurrence during a subsequent time slot within the same timing interval of (a) a set output from said first flip-flop and (b) a second keyboard signal corresponding to said designated keyboard.

4. A truncated decay system according to claim 1 wherein said inhibit signal is used to prevent the output from a generator of said musical instrument, said generator being selected from the group consisting of tone generator, frequency generator, spectrum generator and envelope generator.

* * * * *